US005494324A

United States Patent [19]

Kleefeldt

[11] Patent Number: 5,494,324

[45] Date of Patent: Feb. 27, 1996

[54] BOLT FOR MOTOR-VEHICLE DOOR LATCH

[75] Inventor: Frank Kleefeldt, Heiligenhaus, Germany

[73] Assignee: Kiekert GmbH & Co. KG, Heiligenhaus, Germany

[21] Appl. No.: 198,439

[22] Filed: Feb. 18, 1994

[30] Foreign Application Priority Data

Feb. 27, 1993 [DE] Germany ..... 43 06 151.6

[51] Int. Cl.[6] ..... E05C 21/02

[52] U.S. Cl. ..... 292/340; 292/DIG. 38; 292/DIG. 56; 292/216; 292/341.12

[58] Field of Search ..... 70/340, 341.12, 70/341.13, 341.14, 216, DIG. 38, DIG. 56, DIG. 73

[56] References Cited

U.S. PATENT DOCUMENTS

| | | | |
|---|---|---|---|
| 885,623 | 4/1908 | Keil | 292/337 |
| 4,165,112 | 8/1979 | Kleefeldt . | |
| 4,470,626 | 9/1984 | Gergoe et al. | 292/341.12 |
| 4,733,892 | 3/1988 | Kleefeldt et al. | 292/341.12 |
| 4,783,103 | 11/1988 | Schlegel | 292/341.12 |
| 4,834,435 | 5/1989 | Kleefeldt . | |
| 4,896,908 | 1/1990 | Kleefeldt | 292/216 |
| 4,941,696 | 7/1990 | Yamada et al. | 292/340 |
| 4,981,313 | 1/1991 | Makamura | 292/340 |
| 5,215,342 | 6/1993 | Yuge et al. | 292/340 |

FOREIGN PATENT DOCUMENTS

| | | | |
|---|---|---|---|
| 3137373 | 6/1991 | Japan | 292/341.12 |

*Primary Examiner*—Darnell M. Boucher
*Attorney, Agent, or Firm*—Herbert Dubno; Andrew Wilford

[57] ABSTRACT

The instant invention is used in combination with a door-post surface and a motor-vehicle door latch having a pivotable latch element. It is a bolt assembly having a metal plate unitarily formed with a pair of flat coplanar flanges each formed with a mounting hole and a holding portion projecting laterally from the flanges. A mass of a durable plastic material generally covers at least the flanges of the plate and forms an outside surface engaging the door-post surface and an inside surface turned away from the door-post surface. The bolt is formed at the holding portion with a transversely open recess adapted to receive the latch element. The flanges have raised portions extending to and exposed at the outside surface for direct contact with the door-post surface but otherwise are wholly imbedded beneath the inside and outside surfaces of the mass at the flanges.

5 Claims, 4 Drawing Sheets

FIG. 1
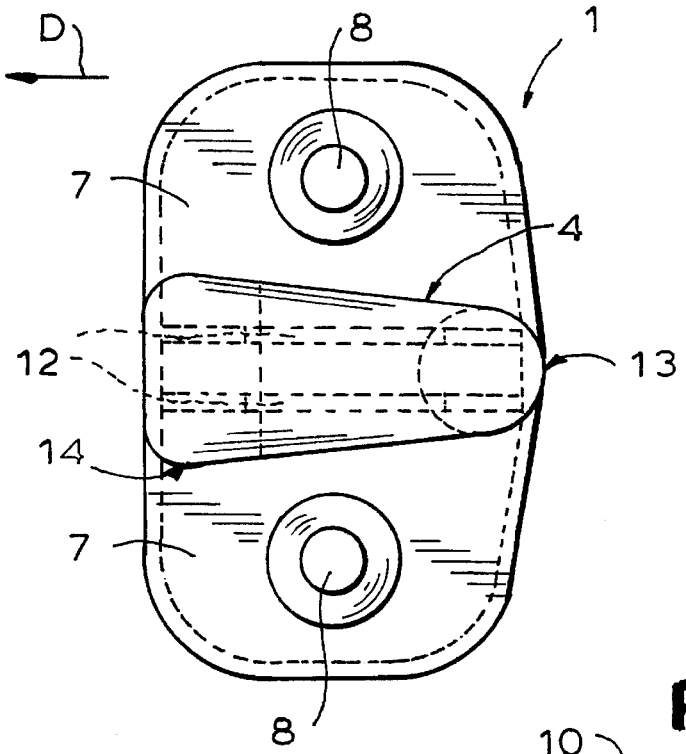
FIG. 2A
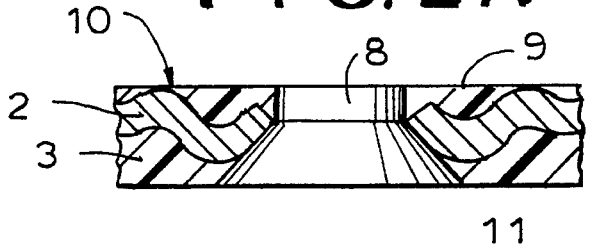
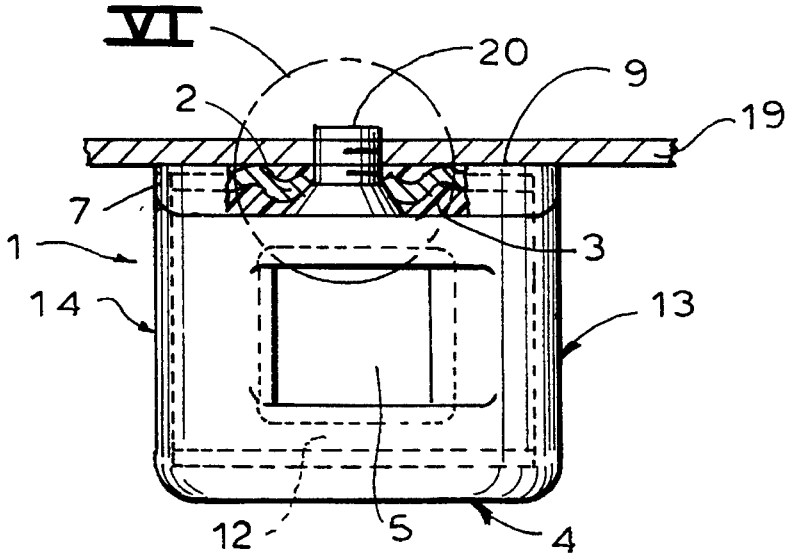
FIG. 2

BOLT FOR MOTOR-VEHICLE DOOR LATCH

FIELD OF THE INVENTION

The present invention relates to a motor-vehicle door latch. More particularly this invention concerns a bolt for use in such a latch.

BACKGROUND OF THE INVENTION

A standard motor-vehicle door latch such as described in commonly owned U.S. Pat. No. 4,165,112 has an eye-type bolt formed of a U-section piece of sheet steel and having upper and lower sides that converge toward each other like a wedge pointed toward the door. A latch housing mounted on the door has an elastomeric guide forming an outwardly open seat having a pair of diverging sides that can fit complementarily over the bolt. A locking fork is pivotal in this latch housing to engage through a vertically through-going hole in the bolt and hold it tightly in place. The sheet-metal parts of the bolt are fitted with an elastomeric insert made of a plastic material to reduce noise and maintain a tight fit.

Commonly owned U.S. Pat. No. 4,834,435 describes a bolt assembly for a motor-vehicle latch wherein the assembly is secured to a doorpost and coacts with a latch fork. It has a metallic U-shaped yoke having an inner flange adapted to be secured to the doorpost and an outer flange spaced therefrom, forming a fork-receiving space therewith, and having an outer surface turned away from the inner flange. A metallic bolt is fixed to the two flanges and extends generally perpendicularly therebetween. A nonmetallic resilient sleeve surrounds the bolt between the flanges and a nonmetallic cover overlies at least the outer surface of the outer flange.

Both of these systems are complexly made of a combination of independently manufactured metallic and plastic parts that not only must be painstakingly manufactured, but must subsequently be assembled together. The metal part is formed with various recesses and seats to which separately manufactured plastic parts must be fitted.

SUMMARY OF THE INVENTION

The instant invention is used in combination with a door-post surface and a motor-vehicle door latch having a pivotable latch element. It is a bolt assembly having according to the invention a metal plate unitarily formed with a pair of flat coplanar flanges each formed with a mounting hole and a holding portion projecting laterally from the flanges. A mass of a durable plastic material generally covers at least the flanges of the plate and forms an outside surface engaging the door-post surface and an inside surface turned away from the door-post surface. The bolt is formed at the holding portion with a transversely open recess adapted to receive the latch element. The flanges have raised portions extending to and exposed at the outside surface for direct contact with the door-post surface but otherwise are wholly imbedded beneath the inside and outside surfaces of the mass at the flanges.

Thus with this system the normally steel reinforcing plate gives great strength to the critical door bolt, while at the same time the plastic covering ensures that it has the exact shape necessary to fit with the door latch. The use of a plastic material also makes the latch work very quietly.

According to the invention the recess is formed in the mass and the plate is relatively deeply imbedded in the mass at the recess but more shallowly imbedded in the mass thereadjacent. Alternately the holding portion is formed as a U-shaped bight bridging and interconnecting the flanges and is substantially free of the plastic mass. The raised portions are immediately adjacent the mounting holes and may be formed as respective annular stiffening welts each surrounding the respective mounting hole. It is also possible for the holding portion to be imbedded in the plastic mass, in which case it can be formed on the holding portion with a cavity provided in turn with an elastomeric filling.

BRIEF DESCRIPTION OF THE DRAWING

The above and other objects, features, and advantages will become more readily apparent from the following description, reference being made to the accompanying drawing in which:

FIG. 1 is a side view of a composite bolt according to this invention;

FIG. 2 is a top view taken in the direction of arrow II of FIG. 1;

FIG. 2A is a large-scale view of the detail indicated at IIA in FIG. 2;

SPECIFIC DESCRIPTION

Figure 6:
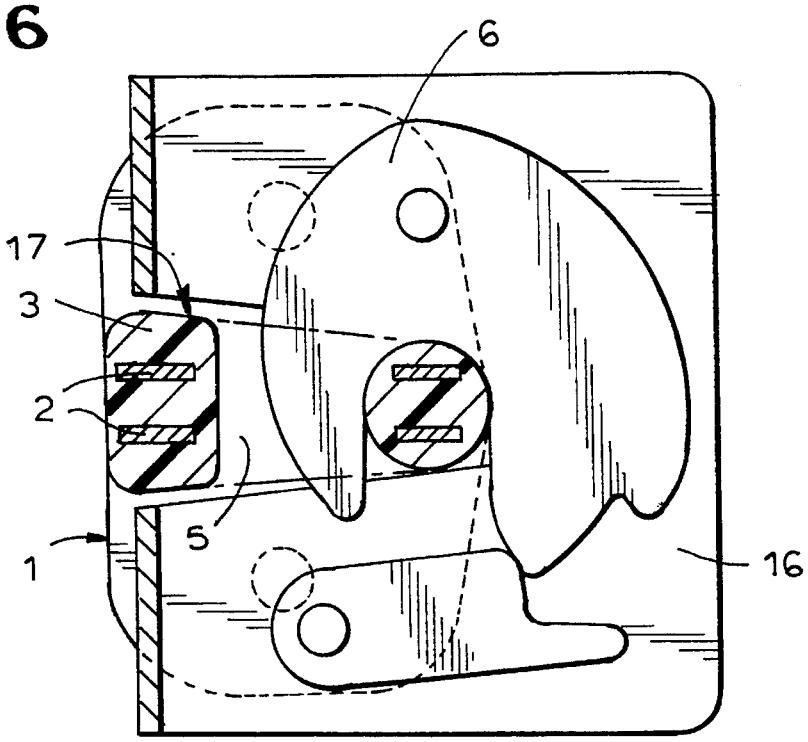
FIG. 6 is a vertical sectional view through the composite bolt of this invention and the associated latch structure.

As seen in FIGS. 1, 2, and 2A, a composite bolt 1 according to this invention is basically formed of a bent sheet-metal reinforcing plate 2 imbedded in and largely covered by a mass 3 of a durable and relatively inelastic plastic material. The bolt 1 has a wedge or eye part 4 extending horizontally relative to a normal door-closing direction D between an outer end 13 and an inner end 14 and formed with a vertically through-going hole 5. FIG. 6 shows how a latch having a housing 16 has a fork 6 pivoted on the housing above a cutout 17 formed in the housing 16, and a retaining pawl 18 pivoted on the housing 16 below the cutout 17 can retain this fork in position with its one leg engaged through the hole 5 and the wedge 4 fitting complementarily in the Cutout. The composite bolt 1 further has a pair of flanges 7 with an outer surface 9 that normally is secured flatly by bolts 20 to a door post 19 and an inner surface 11 turned away from the door post 19.

Figure 3:
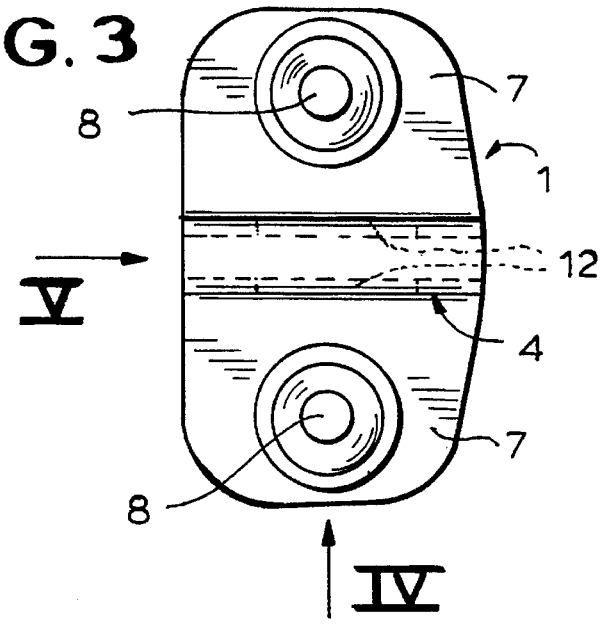
FIG. 3 is a view like FIG. 1 but only showing the metal reinforcement of the composite bolt.
Figure 4:
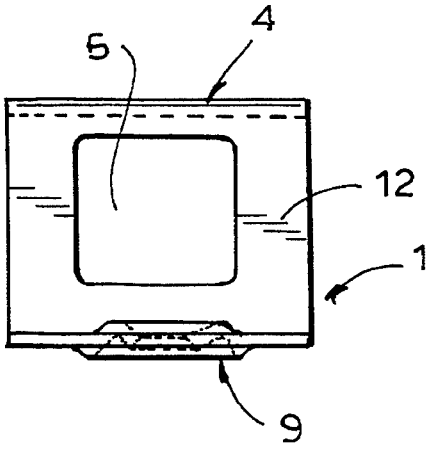
FIGS. 4 and 5 are bottom and end views taken respectively in the direction of arrows IV and V of FIG. 3.
Figure 5A:
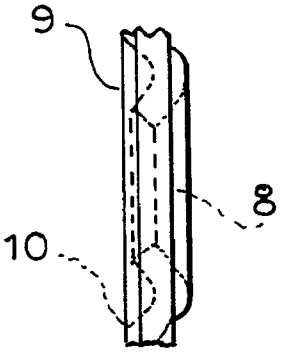
FIG. 5A is a large-scale view of the detail indicated at VA in FIG. 5.
Figure 5:
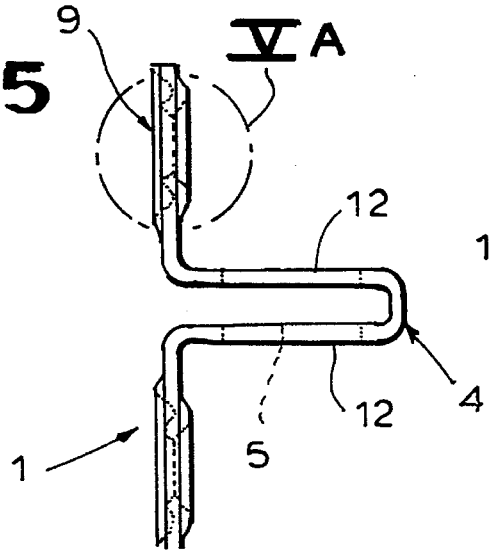

FIGS. 3, 4, 5, and 5A show the metal reinforcing plate 2. It is of uniform thickness and has a U-shaped central bight portion 12 that extends through and lines the wedge 4. In addition as best seen in FIGS. 2A and 5A the plate 2 is formed in the middle of each flange 7 with a throughgoing mounting hole 8 and therearound with a raised welt region 10 that extends to the outer surface 9. Thus the metal of the plate 2 is exposed at the surface 9 around each of these holes 8, ensuring good metal-to-metal contact when the bolt 1 is secured to a door post. In addition when the bolt 1 is being manufactured, it can be set in a mold with the raised portions 10 directly contacting the inner surface of the mold, ensuring very accurate positioning so that during a subsequent injection-molding operation to form the mass 3 the plate 2 remains perfectly positioned.

Figure 7:
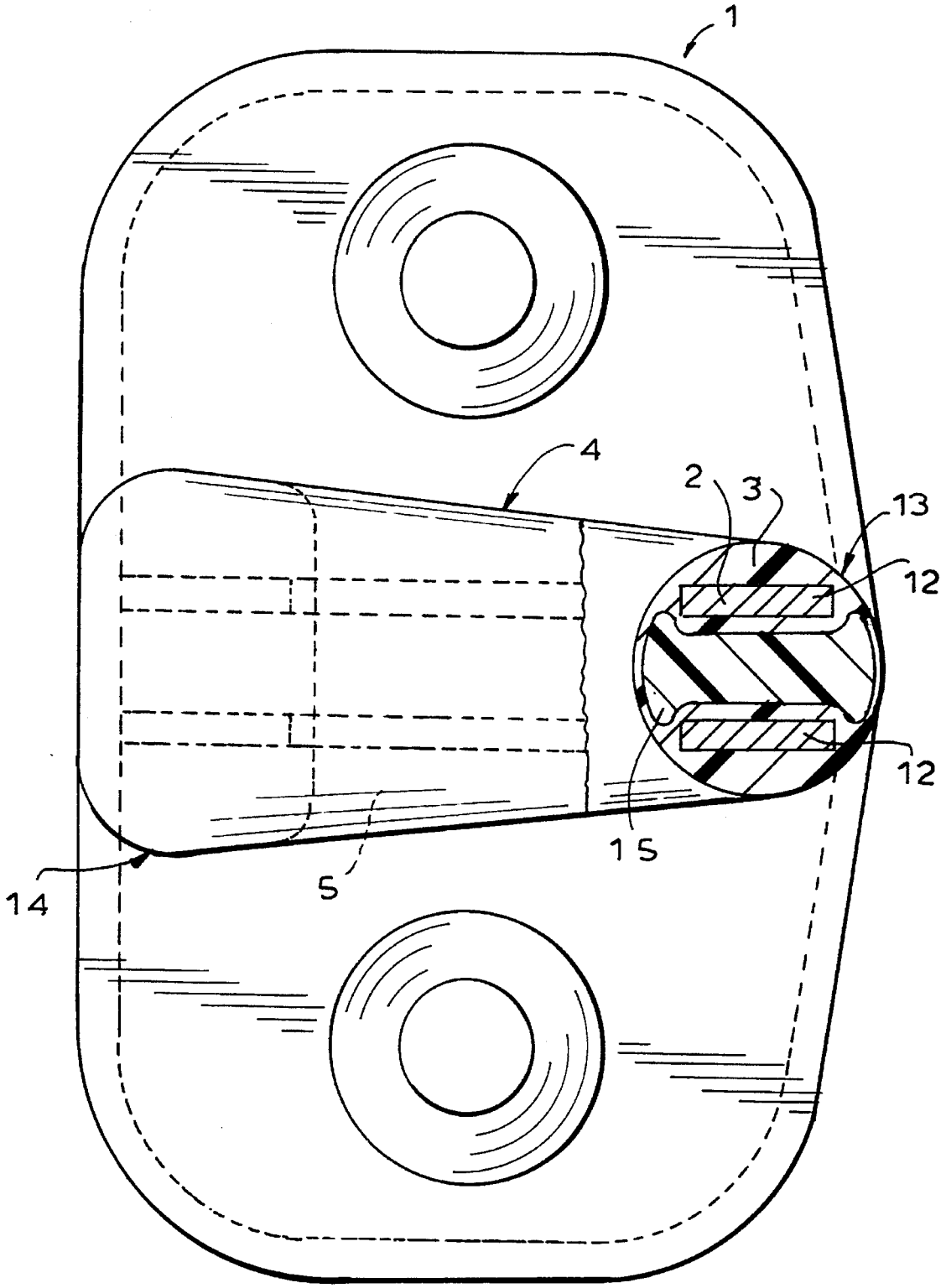
FIG. 7 is a large-scale partly sectional side view of the bolt of the invention.

FIG. 7 furthermore indicates how the enveloping mass 3 of plastic material is formed at the outer end of the eye/wedge 4 with a cavity that is filled with a plug or body of elastomeric material 15. This somewhat quiets operation of the latch and provides some resilience in this critical holding region.

Figure 8:
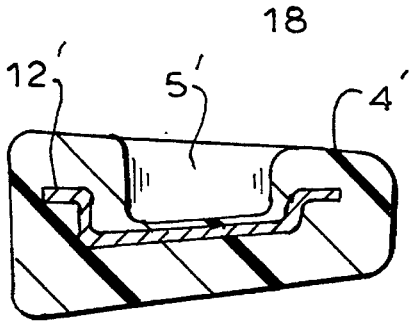
FIG. 8 is a vertical section through a variant eye/wedge according to the invention.

In the arrangement of FIG. 8 an eye-wedge 4' is formed with a blind hole or pocket 5' instead of the throughgoing hole 5 and the reinforcement 12' is imbedded somewhat more deeply in this wedge 4' at this pocket 5' than adjacent it.

Figure 9:
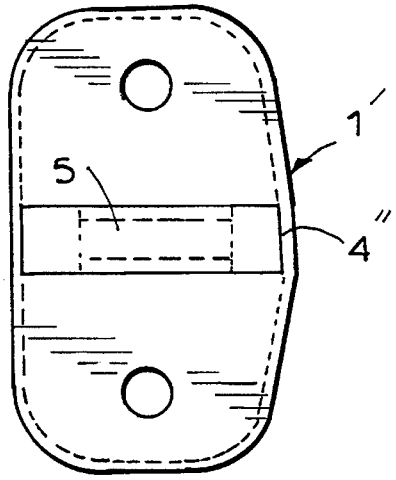
FIG. 9 is a side view of another variant on the system of the invention.

FIG. 9 shows a bolt assembly 1' identical to that of FIG. 1, except that the eye portion 4' here is not imbedded in plastics material at all, that is the U-shaped metal bight 12 is wholly exposed at the eye portion 4' and is formed with the hole 5".

I claim:

1. In combination with a door-post surface and a motor-vehicle door latch having a pivotable latch element, a bolt assembly comprising:

a metal plate unitarily formed with a pair of flat coplanar flanges each formed with a mounting hole and a holding portion projecting laterally from the flanges; and a mass of a durable plastic material covering at least the flanges of the plate and forming an outside surface engaging the door-post surface and an inside surface turned away from the door-post surface, the bolt assembly being formed at the holding portion with a transversely open recess adapted to receive the latch element, the flanges having immediately surrounding each of the holes an annular stiffening welt extending to and exposed at the outside surface for direct contact with the door-post surface but otherwise being wholly imbedded beneath the inside and outside surfaces of the mass at the flanges.

2. The motor-vehicle door bolt assembly defined in claim 1 wherein the recess is formed in the mass and the plate is relatively deeply imbedded in the mass at the recess but more shallowly imbedded in the mass thereadjacent.

3. The motor-vehicle door bolt assembly defined in claim 1 wherein the holding portion is formed as a U-shaped bight bridging and interconnecting the flanges and is substantially free of the mass.

4. The motor-vehicle door bolt assembly defined in claim 1 wherein the holding portion is imbedded in the mass.

5. The motor-vehicle door bolt assembly defined in claim 4 wherein the mass is formed on the holding portion with a cavity provided with an elastomeric filling.

* * * * *